United States Patent [19]

Bohg et al.

[11] 4,371,857

[45] Feb. 1, 1983

[54] ELECTROMAGNETICALLY OPERABLE RAM ACTUATOR IN PARTICULAR FOR IMPACT PRINTERS

[75] Inventors: Armin Bohg, Weil im Schönbuch; Kurt Hartmann, Calw-Heumaden, both of Fed. Rep. of Germany

[73] Assignee: International Business Machines Corporation, Armonk, N.Y.

[21] Appl. No.: 261,312

[22] Filed: May 7, 1981

[30] Foreign Application Priority Data

May 14, 1980 [DE] Fed. Rep. of Germany ..... 3018407

[51] Int. Cl.[3] ..... H01F 3/00; H01F 7/08

[52] U.S. Cl. ..... 335/259; 335/267

[58] Field of Search ..... 335/256, 258, 259, 264, 335/265, 266, 267, 268; 310/24, 30; 101/93.48

[56] References Cited

U.S. PATENT DOCUMENTS

| | | | |
|---|---|---|---|
| 476,236 | 6/1892 | Ayres | 335/259 |
| 2,935,663 | 5/1960 | Pollak | 335/259 |
| 3,491,319 | 1/1970 | Cox et al. | 335/259 |
| 3,859,547 | 1/1975 | Massie | 310/30 |

*Primary Examiner*—Harold Broome
*Attorney, Agent, or Firm*—John S. Gasper

[57] ABSTRACT

An electromagnetic ram actuator, the electromagnet of which consists of two symmetrically designed magnetizable yoke halves. The facing pole ends of the yoke halves are in each case essentially semicircularly recessed, forming two aligned essentially circular operating gaps. Between the operating gaps a ram is arranged which is shiftable in the direction of their line of alignment and whose cross-section is adapted to the area of the operating gaps. The ram comprises two armature disks of magnetizable material and a spacer element arranged therebetween consisting of predominantly non-magnetizable material. One armature disk is associated with each operating gap. The armature disks are geometrically designed in such a manner that their volume is of the order of the operating gap volume. In the starting position of the ram the armature disks are positioned in front of the operating gaps of the electromagnet in its non-excited state. Upon excitation of the electromagnet, they are pulled into its operating gaps, being accelerated in the process. The ram actuator is particularly suitable for use in impact printers.

5 Claims, 7 Drawing Figures

ELECTROMAGNETICALLY OPERABLE RAM ACTUATOR IN PARTICULAR FOR IMPACT PRINTERS

TECHNICAL FIELD

The invention concerns electromagnetic actuators and particularly to electromagnetic actuators used as impactors for printers.

BACKGROUND OF THE INVENTION

Electromagnetic actuators in general must be space saving and the weight of their components substantially reduced to obtain high efficiency. This is particularly true for line printers where several electromagnetic actuators are arranged in adjacent close proximity for the different print positions.

BACKGROUND PRIOR ART

In the related co-pending U.S. patent application, Ser. No. 06/162,993 filed June 25, 1980, an electromagnet is described having a moving armature—in particular for use in print hammer actuators—which consists of two symmetrically designed magnetizable yoke halves which are embraced by one coil each. The facing pole ends of the yoke halves form two operating gaps aligned to each other. Between the operating gaps an armature-like tongue or plate is arranged which is shiftable in the direction of alignment of the operating gaps. This tongue comprises two spaced armature bars of magnetizable material separated by non-magnetizable material which are associated with one operating gap each. The armature bars are geometrically designed in such a manner that their volume is of the order of the operating gap volume. In the starting or rest position of the tongue, when the electromagnet is in its non-excited state, the armature bars are positioned in front of the operating gaps. Upon excitation of the electromagnet, the bars jointly are pulled into their operating gaps, the bars and tongue being rapidly accelerated in the process. In spite of considerable savings in volume and space, the arrangement offers over known print hammer actuators, it has the disadvantage that it is complex and expensive to manufacture and its volume and weight are not as favorable as they ought to be particularly if the overall width required is 2.5 mm.

STATEMENT OF THE INVENTION

It is the object of this invention to improve the design of the electromagnetic actuator of the related application so that it is more suitable for use particularly in impact printers, has minimum volume and low weight to achieve high efficiency and which is relatively easy to manufacture.

The above objective is achieved in accordance with the practice of this invention by providing a pair of co-acting magnetizable stator members at least one of which has an excitation coil wound thereon in which a plurality of pole pieces having facing pole ends form a plurality of linearly aligned circular spaced operating gaps. The actuator element takes the form of a cylindrical ram shaft. The ram shaft is supported for linear motion within the operating gaps. The ram actuator comprises plural spaced magnetizable armature disks, one for each operating gap. The geometrical design of the armature disks is such that their volume is of the order of the space between the facing pole ends, i.e. the disk volume is approximately the same as the space between the facing pole ends assuming there is no ram present. The armature disks may be separate ring disks attached to a slender central bar such as by threading or may be radial extensions integral with a center bar made from a single piece of magnetizable material. In either case, non-magnetizable spacer material such as plastic is provided between the armature disks for making a compact and rigid shaft ram actuator. When the excitation coil is not energized with current, the ram actuator is in a rest or start position such that the armature disks are positioned in front of, i.e. essentially outside of, the operating gaps of the stator pole pieces. When energized, for example with a short fast rising current pulse, the magnet disks are pulled into the operating gaps causing the ram actuator to be linearly shifted with a rapidly accelerating stroke. The stator members and the ram actuator are supported within a central recess of a single thin, flat, frame similar to a picture frame to form a compact actuator unit assembly especially suitable for use in multiple impactor line printers. A spring element attached to the frame engages the ram biasing it to a rest or start position and applying a return force after printing to the same position. The spring element is movably attached to the frame for adjusting the ram actuator starting position. The spring element is preferably a straight wire spring which is attached to the ram actuator in such a manner that the ram actuator is also prevented from rotating or twisting within the guide bearing of the frame. This arrangement provides a compact assembly, easy to manufacture and assemble, while providing low actuator mass for high operating efficiency.

BRIEF DESCRIPTION OF THE DRAWINGS

The details of the invention will be described in connection with the accompanying drawing in which.

DETAILED DESCRIPTION OF THE INVENTION

Figure 6:
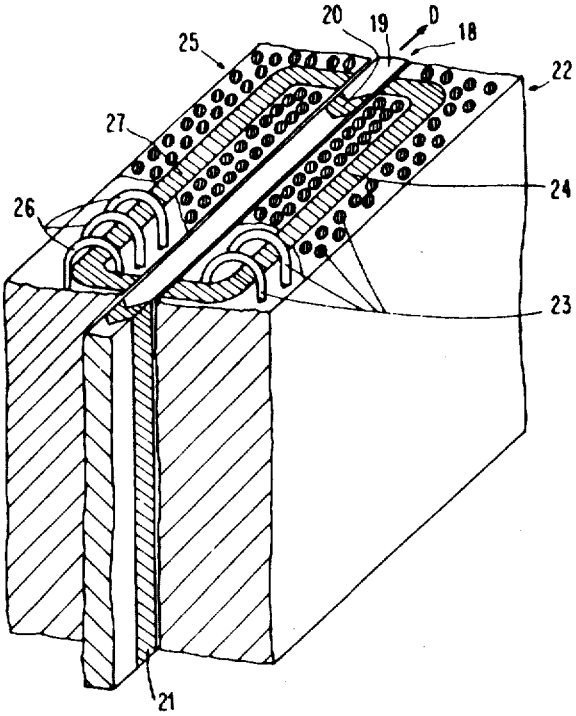
FIG. 6 is a schematic representation of the actuator mechanism of the related co-pending U.S. patent application.

As previously mentioned, the related U.S. application already proposed an electromagnet with a moving tongue actuator for use in print hammer actuators. As shown in FIG. 6, this electromagnet consists of two symmetrically designed magnetizable yoke halves 24, 27 which are embraced by one coil 23, 26 each. The facing pole ends of the yoke halves form two operating gaps aligned in the direction of print. Between the operating gaps an armature-like element 18 (tongue) is arranged which is shiftable in the direction of the line of alignment of the operating gaps. This tongue consists of two armature bars 20, 21 of magnetizable material, each of which is associated with one operating gap. The armature bars are geometrically designed in such a manner that their volume is of the order of the operating gap volume. In the starting position of the tongue 18, the armature bars are positioned in front of their operating gaps of the non-excited electromagnet. Upon excitation of the electromagnet, the bars 20 and 21 are pulled into the operating gaps, being accelerated in the process. The embodiment of this arrangement was directed towards a relatively flat shape of the tongue. Flat meaning that the thickness of the tongue is much smaller than its width and length.

Figure 1:
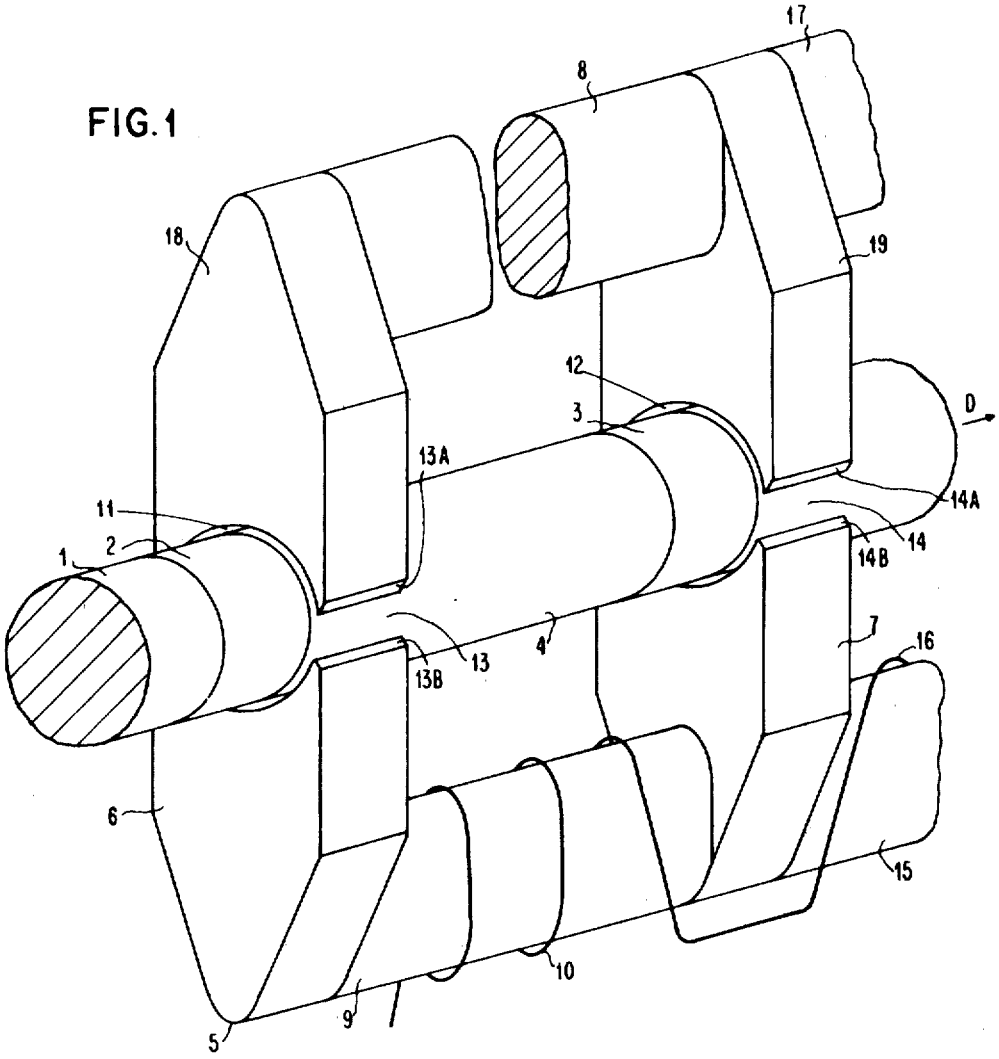
FIG. 1 is a schematic perspective representation of one section of the actuator mechanism of this invention.

This geometrical characteristic led to difficulties in particular where several such arrangements were used in print hammer banks. These difficulties were particularly pronounced in the case of small overall widths of the individual print actuator units. For the character density generally used overall widths of only 2.5 mm would have had to be provided. However, as a result of the small thickness of the tongue, reinforcing ribs were necessary in the tongue's direction of movement. These reinforcing ribs above and below the tongue also served for its accurate guidance. They had to extend above and below the excitation windings (23, 26; FIG. 6), thus considerably increasing the height and mass of the tongue. For an arrangement with one tongue and several yoke half pairs (of a smaller height) arranged one behind the other, the proportion of the undersirable "dead" mass in the reinforcing ribs rose to over 50 percent of the total tongue mass. On the other hand, it was desirable to arrange several partial systems behind each other, because this led to a small overall height of the tongue. To permit printing without subjecting the tongue to considerable bending stresses, a tongue height equalling the character height to be printed was desirable; with an actuator in accordance with FIG. 6 this could be achieved only if at least three yoke half pairs with one common tongue were arranged behind each other. In such a case, however, the additional mass required for the reinforcing or guide ribs exceeded the actual tongue mass. In addition, it was very expensive to manufacture the operating gap between the yoke halves with the necessary accuracy. FIG. 1 is a schematic perspective of a simplified representation of an electromagnetic ram actuator. The cylindrically shaped ram shaft is designed as 1. The operating direction of the ram shaft is marked by arrow D. The ram shaft 1 is made up of soft magnetizable armature rings or armature disks 2, 3 which are separated from each other by a non-magnetizable spacer element 4. For actuating the ram a magnet yoke 5 excitable via a coil 10 is provided. This magnet yoke 5 consists of two symmetrical U-shaped yoke halves or stator members with the limbs (pole shoes) 6, 7 and 18, 19, respectively, as well as the base 9 and 8, respectively. In each case, the base is connected to two pole shoes. The pole shoes of the yoke halves are arranged opposite, but without touching, each other. Each pole shoe is provided with an essentially semicircular recess for accommodating the ram shaft 1. The ram shaft 1 moves in this recess in the direction of arrow D (or opposite thereto). An essentially circular operating gap 11 and 12, respectively, is arranged between the pole shoes. The outer ends 13A, 13B, 14A, 14B of the pole shoes embracing the ram shaft 1 are sloped on their side averted from the ram. The base (coil core) 9 carries a partial winding 10. For clarity's sake, the illustration of a further partial winding on the coil core 8 has been omitted. Upon excitation of the winding 10, a magnetic flux is generated in the magnet yoke 5, which is closed via the pole shoes 6, 18, 19, 7 to form a magnetic circuit. Under the influence of this magnetic flux the armature rings 2, 3 (armature disks) of the ram shaft 1 (which are positioned immediately in front of the operating gaps 11, 12 in the non-excited state of the arrangement) are pulled into the operating gaps, causing the ram shaft 1 to be correspondingly accelerated in the direction of arrow D. For such a function the armature disks 2 and 3 must be made of magnetizable material. The acceleration of the ram shaft 1 is the more efficient, the further the magnetic flux across the armature disks 2 and 3 closes from one pole shoe to another, thus being prevented from extending in the direction of the pole shoe rim without passing the armature ring. For the latter reason, the pole shoes 6, 7, 18, 19 are sloped towards their rims (13A, 13B, 14A, 14B). As seen in FIG. 1, a ram actuator may consist of a series of several magnet yokes arranged one behind the other in the direction of the ram shaft. In such an arrangement adjacent coil cores 8, 17 and 9, 15 would act jointly on one pole shoe pair 7 and 19. In order to maintain the defined operating direction of the ram shaft 1 in the direction of arrow D winding 16 is wound on core 15 in series opposite to the winding 10. In this way the magnetic fluxes from winding 10 and 16 on the two adjacent magnet yokes sharing pole shoe pair 7 and 19 do not cancel each other. The winding for the core 9 and the winding 16 for the core 15 are series connected wound in opposite directions. This applies in analogy to the sense in which the partial coils, not shown, for the coil cores 8 and 17 are wound. This is further shown in FIG. 2 in which the arrangement of yoke sections are arranged adjacently in series. In that arrangement the windings in each yoke section is wound in opposite direction to obtain the desired flux flow in cores and pole pieces.

Figure 2:
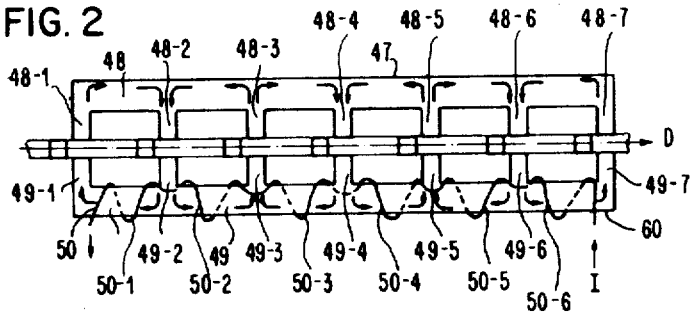
FIG. 2 is a schematic representation of a print ram actuator in accordance with this invention showing the magnetic circuit aspects of this invention.
Figure 3:
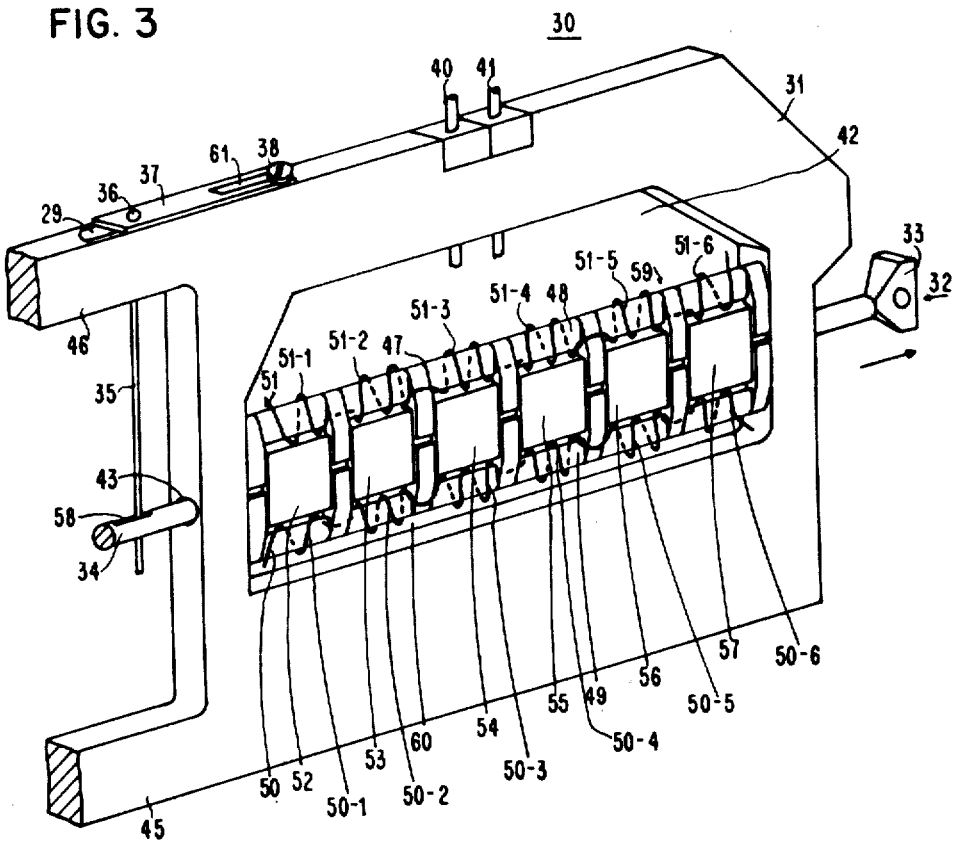
FIG. 3 is a schematic representation of one embodiment of the print ram actuator unit of this invention.
Figure 4:
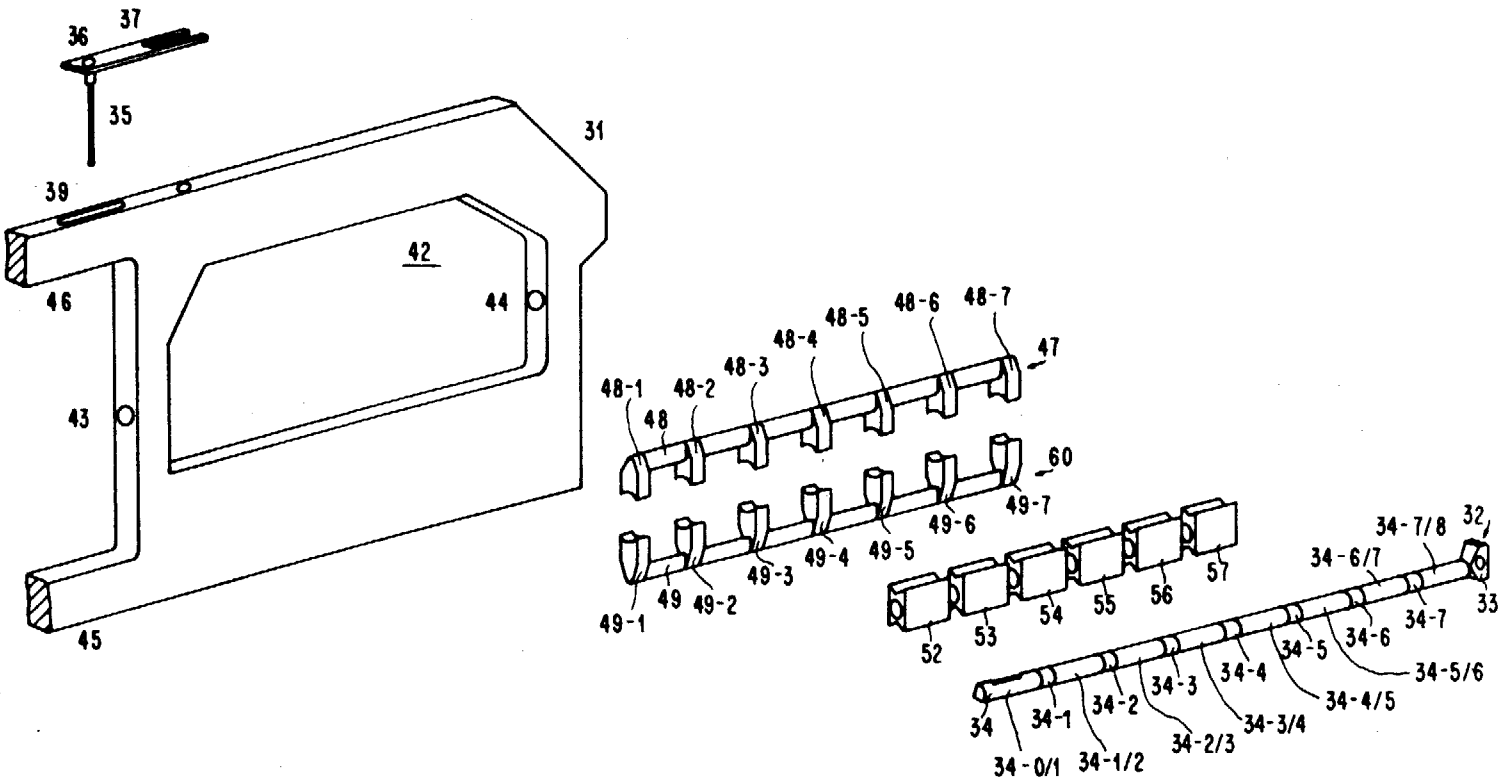
FIG. 4 is an exploded perspective view of the actuator of FIG. 3.

FIG. 1 is extended to a plurality of representations of FIGS. 2, 3 and 4 and concerns a practical embodiment of a print ram actuator unit 30 which is intended for use in line printers. If so-called print hammer actuators (electromagnetically operated print hammers impacting a type to be printed) were previously referred to in connection with the corresponding printers, such a designation is no longer justified for the present novel "ram actuator". The general characteristic of a print hammer actuator was an armature, whose mass was much greater than that actually required for printing the type. In order to keep the impact mass (effective mass) as low as possible regardless of this, it was necessary to connect a correspondingly small impact mass to the great armature mass via a lever. This characteristic is eliminated with the present print ram, as the armature mass and the effective impact mass are identical. With this ram magnetizable partial areas are pulled into the operating gap of an electromagnet circuit, being accelerated in the process, with the ram performing only a linear movement, in contrast to the circular movement of a print hammer. For this reason, the novel actuator will be referred to as (print) ram actuator. A print ram actuator unit 30 serving to operate such a print ram 32 is shown in the perspective view of FIG. 4. For explaining its operation reference will be made to FIGS. 2 and 3. In FIGS. 2, 3 and 4 identical parts are designated by the same referene numbers.

FIG. 2 serves to explain in particular the magnetic flux in the individual magnet yokes arranged one behind the other, whereas FIG. 3 containing an exploded view of the different parts of the print ram actuator unit 30 serves to illustrate how such a unit is assembled. For simplicity's sake it is pointed out that whenever a part is referred to by its reference number, this part will not only be considered in connection with FIG. 3 but also in connection with FIGS. 2 and 4 to the extent to which it is contained in them.

The print ram actuator unit 30, which is designed as a small, flat part, consists of a frame 31 provided with a recess 42. This recess serves to accommodate the magnet coil system 59 (electromagnet unit) which is fixed (glued or cast) to the recess 42. The frame 31 is provided with two bores 43 and 44 serving as guide holes for the cylindrical ram shaft 32. Ram 32 consists of a ram head 33 on the end of the ram shaft 32. The ram shaft 32 is actuated in an axial direction, as marked by arrow D, ram head 33 serving as an element impacting a type or the paper for generating the desired print. The ram shaft 32 extends inside the magnet coil system 59 through recess 42 of frame 31. At its end remote from printing, the frame 31 continues in the form of two frame arms 45 and 46. The end 34 of the ram shaft 32 remote from ram head 33 protrudes into the space between the two frame arms 45 and 46. The end 34 of the ram shaft 32 is provided with an elongated hole 58 for accommodating a spring wire 35 which is fixed to a plate 37 attached to arm 46 of frame 31 stator by means of a screw 38. The spring wire 35 extends downwardly from plate 37 through an elongated hole 39 in the frame arm 46. The spring wire 35 may be fixed to plate 37 at point 36 by welding, gluing or other conventional measures. Plate 37 is provided with a recess 61, which when screw 38 is loosened, permits the plate 37 to be shifted parallel to the direction of the axis of the print ram shaft 32 for adjusting the spring tension of spring wire 35. The spring wire 35 biases the print ram 32 to the start position and provides a return force to that position after completion of printing and spring wire 35 also secures the ram shaft 32 against twisting. The frame 31 has two connecting pins 40 and 41 suitably electrically insulated from the frame 31 and serve to connect the coil of the magnet coil system 59. To extend current source for clarity's sake, the connection of the connecting pins to the ends of the interconnected partial windings 50 and 51 has been omitted. In the magnet coil system 59 illustrated in FIG. 3 consists of a total number of 6 electromagnet circuits or yoke sections in accordance with FIG. 1, which are arranged one behind the other. As previously mentioned, in such an arrangement two adjacent electromagnet circuits have one pole shoe pair in common. For explaining further details of the magnet coil system 59 attention is initially drawn to FIG. 3. The yoke parts of the electromagnet circuits arranged behind each other consist of an upper stator member of a core for an upper coil comb 47 and a core for a lower coil comb 60. The core for the upper coil comb 47 is made up of a comb back 48 on which the comb teeth 48/1, 48/2, 48/3, 48/4, 48/5, 48/6 and 48/7 serving as pole shoes are correspondingly spaced. This applies in analogy to the core of the lower coil comb 60 with the comb back 49 and the comb teeth 49/1 and 49/6 serving as pole shoes. The cores for the upper and the lower coil comb 47 and 60 consist of magnetizable material. The pole shoes are designed in accordance with FIG. 1 in such a manner that the print ram shaft 32 is movable between them in the assembled state of the magnet coil system. The print ram shaft 32 is guided in the frame bores 43 and 44 and in the guide bores of the non-magnetizable guide pieces 52, 53, 54, 55, 56, 57. These guide pieces are arranged in a magnet yoke circuit in such a manner that their bores are in alignment with the bores 43 and 44 in the frame 31. The magnet coil system is cast in plastic in a recess 42 of the frame 31. The arrangement of the windings in the magnet coil systems will be described below. The coil consists of two interconnected partial windings 50 and 51. The partial winding 50 is arranged in the lower coil comb 60, whereas the partial winding 51 is arranged in the upper coil comb 47. The partial windings are arranged on the comb backs 49 and 48, respectively. Care must be taken that the sense in which the windings are wound around the coil core differs for each successive section between two pole shoes. Thus, winding sections 50/1, 50/3, 50/5 are wound in a sense opposite to that of winding sections 50/2, 50/4 and 50/6. This applies in analogy to the sense in which the winding sections are wound around the upper coil comb 47 where the sense in which winding sections 51/1, 51/3 and 51/5 are wound is opposite to that of the winding sections 51/2, 51/4 and 51/6. For obtaining an action force for the print ram, the excitation current must pass the lower partial windings (e.g., 5-/1) and the upper partial windings (e.g., 51/1) of a yoke circuit in such a manner that their magnetic fluxes do not cancel each other.

It is pointed out that the windings can be arranged on the cores of the individual coil combs in a simple manner (which was not the case with the arrangement of FIG. 6). After the individual parts of the magnet coil systems have been cast and fixed in the recess 42 of the frame 31 (fixing may also be effected by casting), the print ram 32 for this system is only introduced into the guide opening provided for this purpose. As shown in FIG. 3, the print ram consists of a number of armature disks 34/1, 34/2, 34/3, 34/4, 34/5, 34/6, 34/7 of magnetizable material corresponding to the number of pole shoe pairs. These individual armature disks are separated from each other by spacer elements 34-0/1, 34-1/2, 34-2/3, 34-3/4, 34-4/5, 34-5/6, 34-6/7. In addition, further spacer elements 34-0/1 and 34-7/8 are provided at the end close to and remote from printing. Spacer elements and armature disks are rigidly fixed to each other. Details on the different ways in which such a print ram may be manufactured will be provided further on. The individual armature disks are spaced from each other in such a manner that they are positioned immediately in front of the operating gap between the individual pole shoe pairs in the non-excited state of the magnet coil system. Upon excitation of the magnet coil system the magnetizable armature disks are pulled into the operating gaps, during which process the complete print ram is accelerated for a subsequent print operation. FIG. 2 shows a schematic sectional view of the parts of the upper and the lower coil comb 47 and 60 which are descriptive of the magnetic flux in the individual yoke circuits according to the representation of FIG. 4. The sectional plane is parallel to the frame area, extending through the axis of the print ram 34. The comb backs are designated as 48 and 49, respectively. The individual comb teeth (pole shoes) are designated as 48/1 to 48/7 and 49/1 to 49/6. For clarity's sake, only the lower partial winding 50 with the winding sections 50/1 to 50/6 is shown. It will be seen that the sense in which successive winding sections are wound alternates to prevent the magnetic fluxes of adjacent yoke circuits in the pole shoe pair common to said circuits from cancelling each other. In the representation of FIG. 2 the print ram is positioned in such a manner that the individual armature disks 34/1 to 34/6 are still in front of the operating gaps. In response to an excitation indicated by the directions of the magnetic flux lines, the print ram would be moved in the direction of arrow D, during which process the magnetizable armature disks would be pulled into the operating gaps between the pole shoes and be accelerated.

Figure 5A:
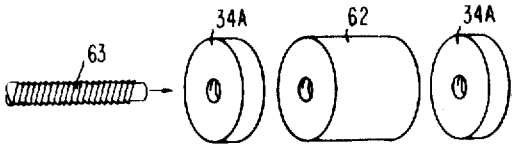
FIG. 5A is a schematic representation showing a first embodiment of the ram actuator element of the actuator of FIGS. 3 and 4.
Figure 5B:
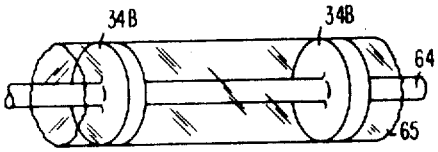
FIG. 5B is a schematic representation illustrating the manufacture of a second embodiment of a ram actuator element for the actuators of FIGS. 3 and 4.

FIGS. 5A and 5B show different possibilities for manufacturing and assembling the print ram.

In accordance with a first embodiment shown in FIG. 5A, the individual armature disks 34A and the spacer elements 62 arranged between them are screwed to a common ram shaft core 63 which is designed as a threaded pin. All parts may be glued to each other. Subsequent grinding of the ram ensures a very high degree of accuracy of the ram diameter. The armature disks 34A and the spacer elements 62 must have very small length tolerances, to ensure that the individual armature disks 34A are accurately spaced. An accurate pitch of the armature disks is a prerequisite for a high degree of efficiency.

The difficulties in the manufacture of a ram according to FIG. 5A can be avoided by turning the armature disks 34B and the ram shaft core 64 connecting them out of one piece, thus ensuring an accurate armature disk pitch. For manufacturing a complete ram, the latter is connected to a ram head 33 (see FIG. 4) and an end part with the elongated hole 58 (see FIG. 4) by means of plastic embedding. The dimensional accuracy required is obtained by subsequent grinding.

It is pointed out that in the case of the embodiment of FIG. 5B the ram shaft core 64 and the armature rings 34B are made of the same magnetizable material. For the efficiency of the arrangement it is essential that the diameter of the ram shaft core is relatively small in comparison with the diameter of the armature disks 34B, to prevent an undesirable conductance of magnetic fluxes by the ram shaft core. From the standpoint of maximum efficiency, the space between the armature disks should be made in full of non-magnetizable material. However, for manufacturing reasons, this requirement may be ignored, if one is prepared to accept a slight decrease in efficiency. By suitably pairing the material for the guide pieces 52 and 57 and the ram shaft 34, an easy running fit of the print ram 32 can be obtained in the guide bores 43 and 44, without any lubrication being required.

The above-described ram actuator can be used for a multitude of purposes, in particular for generating predetermined forces, displacements, momenta or kinetic energies or switching processes which are controlled by contacts actuated by the ram.

The ram actuator described can also be used bidirectionally, if the armature disks assume defined final positions in front of and behind the operating gaps, respectively.

Having thus described my invention, what I claim as new, and desire to secure by Letters Patent is:

1. An electromagnetic actuator unit assembly comprising a thin, flat, rectangular frame having a central recess, a ram actuator carried by said frame comprising a cylindrical ram shaft slidably supported within guide holes through opposite sides of said frame, said ram shaft having a central portion within said recess with opposite end portions extending beyond said opposite sides of said frame, and a ram head fixed to one of said end portions outside of said frame, said ram shaft having a plurality of longitudinally separated magnetic armature disks in said central portion, and electromagnetic operating means supported by said frame within said recess for actuating said ram actuator in an axial direction, said operating means comprising upper and lower co-acting electromagnetic stator members, said stator members comprising magnetic core means having a plurality of longitudinally spaced magnetic pole pieces and an excitation winding on at least one of said core means, said magnetic pole pieces of said stator members having opposite pole faces aligned and shaped to form a plurality of longitudinally separated circular operating gaps for receiving one each of said armature disks in said central portion of said actuator shaft, and means supported by said frame member for biasing said ram actuator to a starting position whereby in the non-energized state of said excitation winding said armature disks are positioned in front of their operating gaps and are pulled into said operating gaps upon energization of said winding.

2. An electromagnetic actuator unit assembly in accordance with claim 1 in which said means for biasing said ram actuator comprises spring means attached to said frame member and to the end portion of said ram extending beyond one side of said frame opposite said end portion having said ram head.

3. An electromagnetic actuator unit assembly in accordance with claim 2 in which said spring means for biasing said ram actuator is longitudinally movable on said frame for adjusting the starting position of said ram actuator.

4. An electromagnetic actuator unit assembly in accordance with claim 3 in which said longitudinally movable spring means comprises a plate member slidable on said frame, a spring wire having a fixed end attached to said frame and a free end for connection to the end portion of said ram shaft opposite said ram head.

5. An electromagnetic actuator unit assembly in accordance with claim 3 in which said spring wire is connected to said end portion of said ram shaft through an opening perpendicular to the longitudinal axis of said ram shaft, said spring wire engaging said end portion of said ram shaft in said opening in a manner which prevents rotation of said ram shaft on said longitudinal axis.

* * * * *